US010840646B2

(12) United States Patent
Zhang et al.

(10) Patent No.: US 10,840,646 B2
(45) **Date of Patent: *Nov. 17, 2020**

(54) ANTI-MISPLUG COAXIAL CONNECTOR ASSEMBLY

(71) Applicant: CommScope Technologies LLC, Hickory, NC (US)

(72) Inventors: Yujun Zhang, Jiangsu (CN); Hongjuan An, Jiangsu (CN); Jin Liu, Jiangsu (CN); Jien Zheng, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,805

(22) Filed: May 14, 2020

(65) Prior Publication Data

US 2020/0274296 A1 Aug. 27, 2020

Related U.S. Application Data

(63) Continuation of application No. 16/269,707, filed on Feb. 7, 2019, now Pat. No. 10,658,794.

(30) Foreign Application Priority Data

Feb. 24, 2018 (CN) ..... 2018 1 0155951

(51) Int. Cl.
*H01R 13/645* (2006.01)
*H01R 13/52* (2006.01)
(Continued)

(52) U.S. Cl.
CPC ..... *H01R 13/645* (2013.01); *H01R 13/5219* (2013.01); *H01R 13/622* (2013.01);
(Continued)

(58) Field of Classification Search
CPC ..... H01R 13/645; H01R 13/5219; H01R 13/622; H01R 13/631; H01R 13/111;
(Continued)

(56) References Cited

U.S. PATENT DOCUMENTS 5,074,809 A * 12/1991 Rousseau ..... H01R 24/44 439/578
5,154,635 A * 10/1992 Kaufman ..... H01R 24/52 174/111
(Continued)

FOREIGN PATENT DOCUMENTS

| | | |
|---|---|---|
| WO | 2017/120801 | 7/2017 |
| WO | 2018/086077 | 5/2018 |
| WO | 2018/184229 | 10/2018 |

OTHER PUBLICATIONS

International Preliminary Report on Patentability corresponding to International Application No. PCT/US2019/017216 dated Sep. 3, 2020.

*Primary Examiner* — Harshad C Patel
(74) *Attorney, Agent, or Firm* — Myers Bigel, P.A.

(57) ABSTRACT

An anti-misplug coaxial connector assembly includes a female connector and a male connector. The female connector includes: a first inner conductor provided with an accommodation cavity defining a longitudinal axis; a first outer conductor; and a first insulator arranged between the first inner conductor and the first outer conductor. The male connector includes: a second inner conductor, a second outer conductor, and a second insulator arranged between the second inner conductor and the second outer conductor. The first outer conductor and the second outer conductor form radial contact by means of a resilient finger-shaped element that surrounds the second insulator. The first insulator includes a main body portion circumferentially surrounding the first inner conductor and a shoulder portion protruding
(Continued)

outwardly along the radial direction relative to the main body portion so as to engage the first outer conductor.

16 Claims, 6 Drawing Sheets

(51) Int. Cl.
*H01R 24/40* (2011.01)
*H01R 13/622* (2006.01)
*H01R 13/631* (2006.01)
*H01R 103/00* (2006.01)

(52) U.S. Cl.
CPC ..... *H01R 13/631* (2013.01); *H01R 24/40* (2013.01); *H01R 2103/00* (2013.01)

(58) Field of Classification Search
CPC ..... H01R 13/50; H01R 13/207; H01R 24/40; H01R 2103/00
USPC ..... 439/277, 578–595, 607.04
See application file for complete search history.

(56) References Cited

U.S. PATENT DOCUMENTS 5,217,391 A * 6/1993 Fisher, Jr. ..... H01R 24/44 439/578
5,474,470 A * 12/1995 Hammond, Jr. ..... H01R 24/44 439/578
5,611,707 A * 3/1997 Meynier ..... H01R 13/6277 439/353
6,102,738 A * 8/2000 Macek ..... H01R 4/5075 439/584
6,609,925 B1 * 8/2003 Cannon ..... H01R 13/625 439/332
6,663,397 B1 * 12/2003 Lin ..... H01R 13/6277 439/154
8,246,392 B2 * 8/2012 Amidon ..... H01R 13/623 439/851
8,827,743 B1 * 9/2014 Maury ..... H01R 13/622 439/578
8,888,519 B2 * 11/2014 Baumler ..... H01R 13/6315 439/248
9,831,619 B2 * 11/2017 Mahmood ..... H01R 24/38
10,069,255 B1 * 9/2018 Mahmood ..... H01R 24/38
10,148,047 B2 * 12/2018 Wimmer ..... H01R 13/631
2003/0137372 A1 7/2003 Fehrenbach et al.
2015/0200469 A1 * 7/2015 Vaccaro ..... H01R 13/24 439/578
2016/0020534 A1 1/2016 Paynter
2016/0322751 A1 11/2016 Van Swearingen et al.
2017/0110839 A1 4/2017 Vaccaro
2018/0026409 A1 1/2018 Kim

* cited by examiner

ANTI-MISPLUG COAXIAL CONNECTOR ASSEMBLY

RELATED APPLICATION

The present application is a continuation of U.S. patent application Ser. No. 16/269,707, filed Feb. 7, 2019, which claims priority from and the benefit of Chinese Patent Application No. 201810155951.4, filed Feb. 24, 2018, the disclosure of which is hereby incorporated herein by reference in its entirety.

FIELD OF THE INVENTION

The present disclosure generally relates to the field of coaxial connectors. More specifically, the present disclosure relates to an anti-misplug coaxial connector assembly for radio frequency.

BACKGROUND OF THE INVENTION

A coaxial cable is commonly used in a radio frequency (RF) communication system. A coaxial connector is typically attached to the end portion of the cable, so that the cable can be connected with a device or other cables. A connector interface provides a connection/disconnection function between the cable terminated with a connector and a connector installed on the device or another cable and provided with a corresponding matched connector interface.

The radio frequency coaxial connector interface, generally referred to as the 4.3-10 interface, is being considered by the International Electrotechnical Commission (International Standards Organization) as a standardized coaxial connector interface. The 4.3-10 connector interface may be connected by a tool, by manual operation, or is used as a "quick connection" connector. As shown in FIG. 1 and FIG. 2, a 4.3-10 female connector 5 (shown on the left side of the figure) has an outer conductor 10. The outer conductor is provided with a resilient finger-shaped element 12, and the resilient finger-shaped element 12 engages an inner diameter of an engagement cylinder 15 of a mating 4.3-10 male connector 20 (shown on the right side of the figure). This engagement establishes the electrical contact between the outer conductors of the connectors 5, 20.

Earlier adopters of the 4.3-10 connection interface have applied these connectors to communication devices such as cellular base station antennas. In some cases, the device includes connectors for multiple types of connector interfaces, and the type of the connector is generally selected based on the diameter of the coaxial cable connected to the device.

One of these alternative connectors is known as a 4.1-9.5 (the outer diameter of the inner conductor is 4.1 mm, and the inner diameter of the outer conductor is 9.5 mm) or "Mini-Din" (Miniature German industry standard) connector. The 4.1-9.5 type male connector 25 (shown on the right sides of FIG. 3 and FIG. 4) has a smaller total connection interface, and the smaller total connection interface uses a similar male outer conductor connection cylinder 30 with a smaller diameter. The male outer conductor cylinder 30 includes a chamfered and/or rounded outer leading edge 35 (see FIG. 4). The 4.1-9.5 type connector uses a coupling nut 40', and the coupling nut has the same thread configuration as the 4.3-10 coupling nut 40. As the 4.1-9.5 type connector 25 looks almost the same as the 4.3-10 male connector 20 and uses the same coupling nut 40', the installer may mistakenly attempt to attach the 4.1-9.5 type male connector 25 to the 4.3-10 female connector 5. If the initial resistance is overcome, then the resilient finger-shaped element 12 of the 4.3-10 outer conductor 10 will flare outward, therefore the 4.1-9.5 type connector 25 is inserted into the engaged position of the coupling nut 40'. At this time, the further torquing of the coupling nut 40' may result in incorrect interconnection. The resilient finger-shaped element 12 of the 4.3-10 outer conductor 10 may be bent to a permanently open position, thereby preventing later interconnection with the correct 4.3-10 male connector 20. In addition to disrupting the female 4.3-10 connector 5 (which renders the device mounted thereon unusable), a mismated connection to the 4.1-9.5 type connector 25 may result in that improper power/signal being transmitted to another offline device destructively.

In view of the above problems, it is desirable to provide an alternative connector that prevents mismating of the 4.1-9.5 type connector.

SUMMARY OF THE INVENTION

One objective of the present disclosure is to provide an anti-misplug coaxial connector that may prevent at least one defect in the prior art.

According to one aspect of the present disclosure, an anti-misplug coaxial connector assembly for preventing the mismating of a 4.1-9.5 type connector is provided, the anti-misplug coaxial connector assembly includes a female connector and a male connector, each of the female connector and the male connector has a free end portion. The female connector and the male connector are cooperatively connected with each other by the free end portions. The female connector includes: a first inner conductor provided with an elongated accommodation cavity defining a longitudinal axis; a first outer conductor; and a first insulator for isolating and supporting the first inner conductor and the first outer conductor, arranged between the first inner conductor and the first outer conductor. The male connector includes: a second inner conductor provided with an elongated pin that can be inserted into the elongated accommodation cavity of the first inner conductor, a second outer conductor in radial contact with the first outer conductor when the female connector and the male connector are cooperatively connected with each other, and a second insulator for isolating and supporting the second inner conductor and the second outer conductor, arranged between the second inner conductor and the second outer conductor. The first outer conductor and the second outer conductor form radial contact by means of a resilient finger-shaped element; the resilient finger-shaped element surrounding the second insulator. The first insulator includes a main body portion circumferentially surrounding the first inner conductor. The first insulator includes a shoulder portion on an end portion opposite to the free end portion, and the shoulder portion protruding outwardly along a radial direction relative to the main body portion so as to engage the first outer conductor, and the outer diameter of the main body portion of the first inner conductor is greater than the inner diameter of the outer conductor of a male connector of the 4.1-9.5 type connector.

BRIEF DESCRIPTION OF THE DRAWINGS

Aspects of the present disclosure may be better understood upon reading the following detailed description in conjunction with the drawings, in which.

DETAILED DESCRIPTION OF THE EMBODIMENTS

Figure 1:
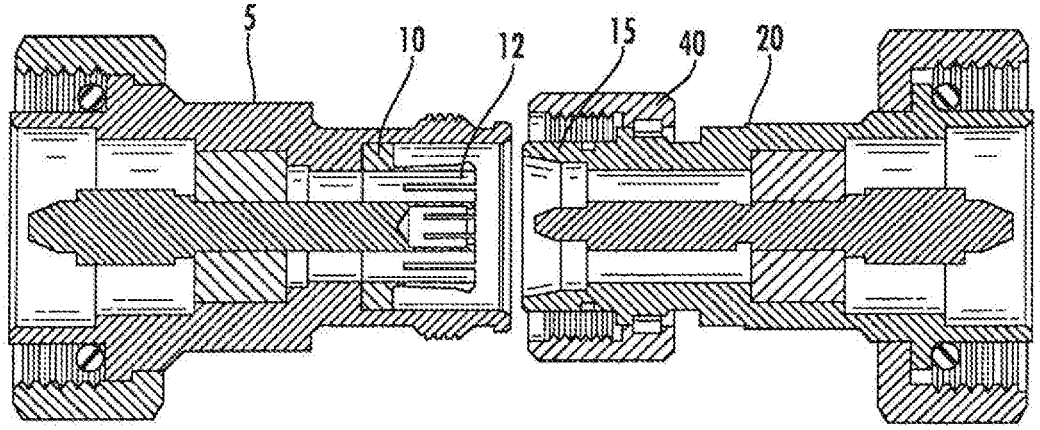
FIG. 1 is a schematic section view of a male connector and a female connector, which are aligned to each other to be interconnected of the conventional 4.3-10 connector (the conventional 4.3-10 connector refers to a connector that the outer diameter of an inner conductor is 4.3 mm and the inner diameter of an outer conductor is 10 mm).
Figure 2:
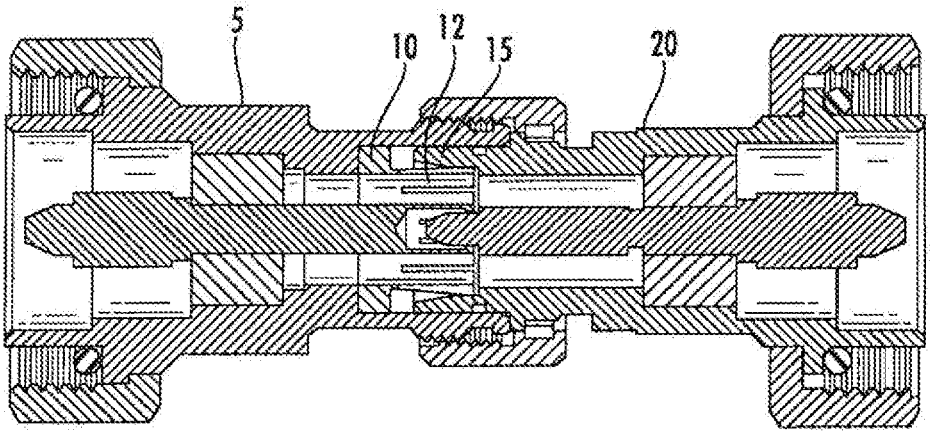
FIG. 2 is a schematic section view of the matched conventional 4.3-10 connector of FIG. 1.
Figure 3:
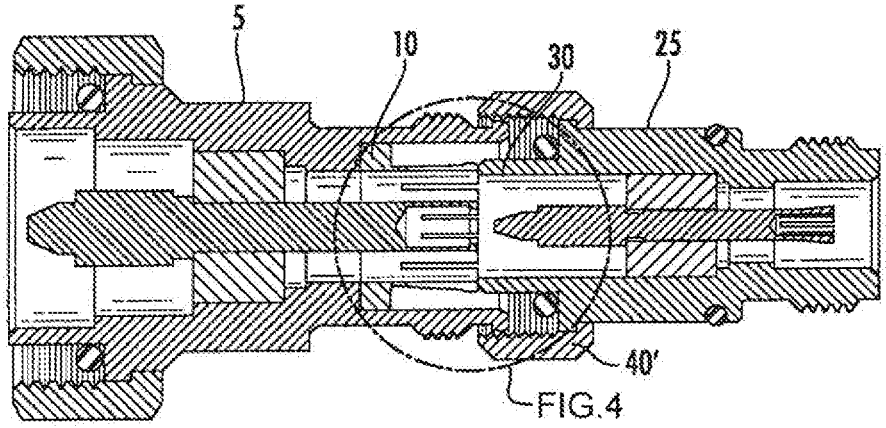
FIG. 3 is a schematic section view of a mismated interconnection of the conventional 4.3-10 connector of FIG. 1 and a representative 4.1-9.5 type male connector.
Figure 4:
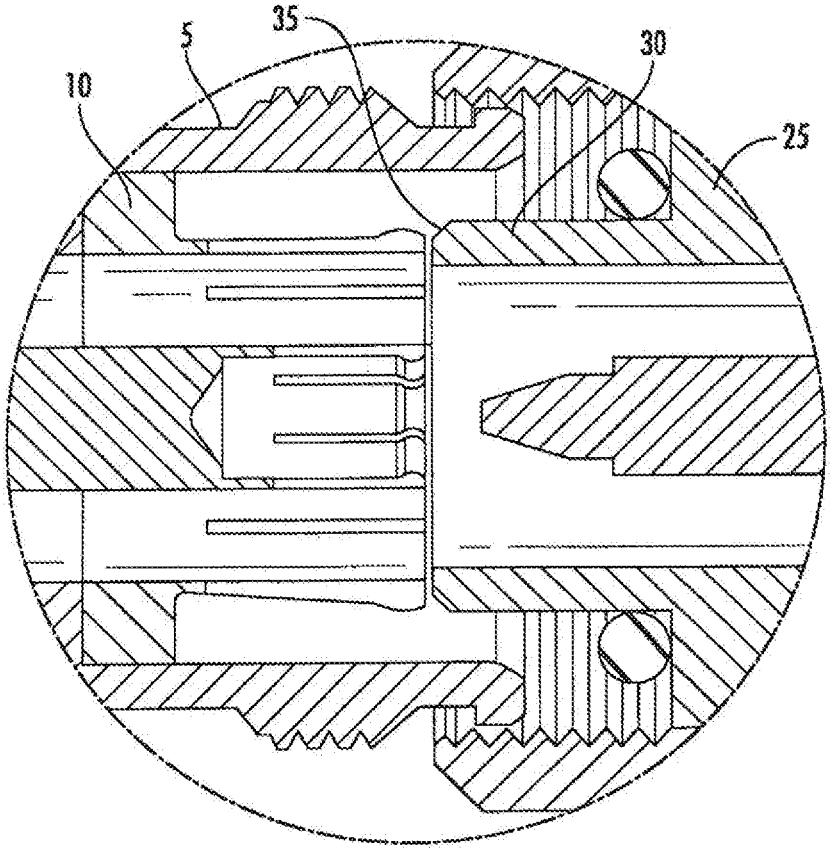
FIG. 4 is a schematic enlarged view of the connector of FIG. 3, and the schematic enlarged view shows a chamfered outer edge of the 4.1-9.5 type male connector that may be easily overcome to start the mismated interconnection.

The present disclosure will be described below with reference to the drawings, in which several embodiments of the present disclosure are shown. It should be understood, however, that the present disclosure may be embodied in various different manners and is not limited to the embodiments described below; in fact, the embodiments described below are intended to make the disclosure of the present disclosure be more complete and to fully explain the protection scope of the present disclosure to those skilled in the art. It should also to be understood that the embodiments disclosed herein may be combined in various manners to provide more additional embodiments.

It should be understood that throughout the drawings, the same reference signs indicate the same elements. In the drawings, the sizes of some features may be modified for clarity.

It should be understood that the words used in the specification are for the purpose of describing particular embodiments only, and are not intended to limit the present disclosure. All terms used in the specification (including technical terms and scientific tefins) have the meaning as commonly understood by those of ordinary skill in the art, unless otherwise defined. For the purpose of conciseness and/or clarity, well-known functions or structures may not be described in detail.

The singular forms "a", "said" and "the" used in the specification, unless otherwise indicated, contain the plural forms. The terms "including," "comprising," and "containing" used in the specification indicate the existence of the claimed features, but do not exclude the presence of one or more other features. The words "and/or" used in the specification include any and all combinations of one or more of the associated listed items. The words "between X and Y" and "between about X and Y" used in the specification should be construed as including X and Y. The word "between about X and Y" used in the specification means "between about X and about Y", and the word "from about X to Y" used in the specification means "from about X to about Y".

In the specification, when one element is referred to as being "on" another element, "attached to" another element, "connected" to another element, "coupled" to another element, or "contacting" another element, the element may be located directly on the other element, attached to the other element, connected to the other element, coupled to the other element or in contact with the other element, or an intermediate element may be present. By contrast, when an element is referred to as being "directly" located "on" another element, "directly attached" to another element, "directly connected" to another element, "directly coupled" to another element, or "in direct contact with" another element, the intermediate element is not present. In the specification, one feature is arranged to be "adjacent" to another feature, which may mean that one feature has a portion overlapping with the adjacent feature or a portion located above or below the adjacent feature.

In the specification, the spatial relationship terms such as "up", "down", "left", "right", "front", "back", "high", "low" and the like may describe the relationship between one feature and another feature in the drawings. It should be understood that the spatial relationship terms, in addition to the orientations shown in the drawings, also include different orientations of the device in use or operation. For example, features previously described as "below" other features while the device in the figures is turning over may now be described as being "above" the other features. The device may also be oriented (rotated by 90 degrees or at other orientations) in other manners, and at this time, the relative spatial relationship is explained correspondingly.

As described above, the incorrect cooperation between the 4.1-9.5 type connector and the conventional 4.3-10 connector may result in damage to the 4.3-10 connector. The present disclosure provides a 4.3-10 type coaxial connector interface that is different from the conventional 4.3-10 connector, and the coaxial connector interface may prevent mismated interconnection with the similar coaxial connector interface (e.g., the 4.1-9.5 type connector). The 4.3-10 type coaxial connector and the 4.1-9.5 type coaxial connector given herein are exemplary, and the anti-misplug coaxial connector of the present disclosure may also be connectors with other sizes.

Figure 6:
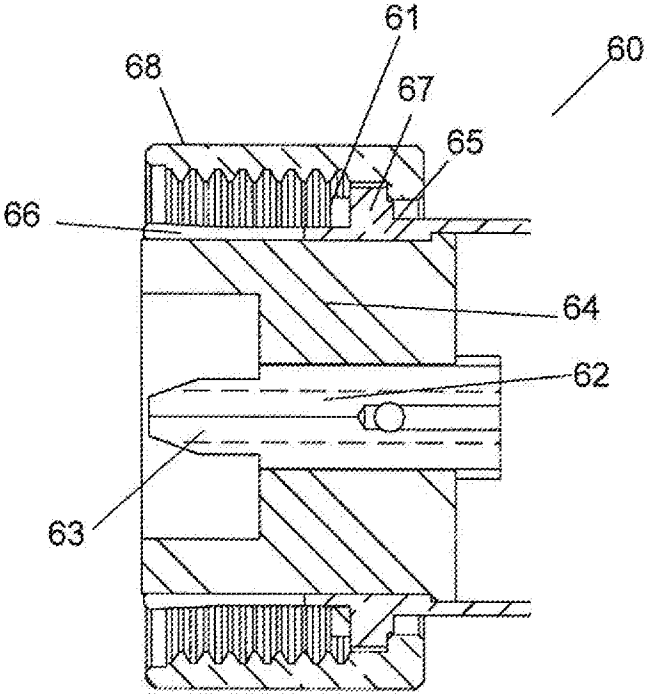
FIG. 6 shows a section view of a male connector to be interconnected with the female connector as shown in FIG. 5 according to an embodiment of the present disclosure.
Figure 5:
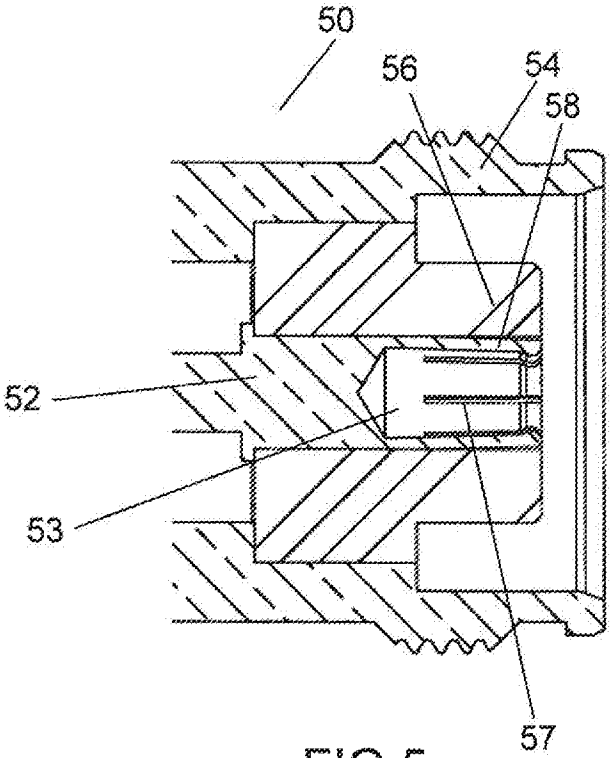
FIG. 5 shows a section view of a female connector according to an embodiment of the present disclosure.
Figure 7:
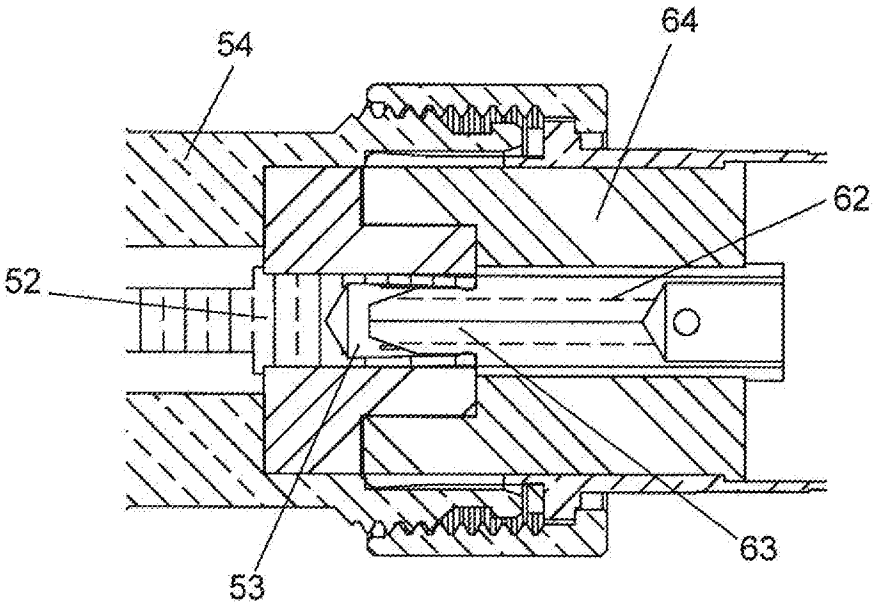
FIG. 7 shows a section view of the male connector as shown in FIG. 6 plugged into the female connector as shown in FIG. 5.

As shown in FIG. 5 to FIG. 7, the 4.3-10 type coaxial connector of the present disclosure is shown. The coaxial connector includes a female connector 50 and a male connector 60. Each of the female connector 50 and the male connector has a free end portion (the free end portion herein refers to an end portion in a free state when the female connector 50 and the male connector 60 are not cooperatively connected with each other), and the female connector 50 and the male connector 60 are cooperatively connected with each other by means of the free end portion of the female connector and the free end portion of the male connector. In the case of mutual cooperation, an inner conductor 62 and an outer conductor 65 of the male connector 60 are correspondingly plugged into the inner conductor 52 and the outer conductor 54 of the female connector 50 so as to realize the electrical interconnection between the male connector 60 and the female connector 50. The coaxial connector further includes a clamping nut 68, which may be arranged on the male connector. The clamping nut 68 includes internal threads used for matching with external threads of the female connector 50 to form a threaded clamping connection between the female connector 50 and the male connector 60. As an example, the clamping nut adopts a standard coupling nut structure of the conventional 4.3-10 type connector, and the diameter of the internal thread is about 20 mm.

Specifically, FIG. 5 shows one example of the female connector 50 of the anti-misplug coaxial connector according to the present disclosure. As shown in FIG. 5, the female connector 50 includes an inner conductor 52, an insulator 56 and an outer conductor 54. The inner conductor 52 defines a longitudinal axis of the coaxial connector and is provided with an elongated accommodation cavity 53 for accommodating a pin 63 of the male connector 60. The elongated accommodation cavity 53 is defined by a resilient finger-shaped element 58. The resilient finger-shaped element 58 is provided with a plurality of slots 57 extending along the longitudinal axis. The plurality of slots 57 are uniformly arranged along the circumferential direction of the resilient finger-shaped element, wherein 3-8 slots 57 are formed (commonly 8). As an example, the inner diameter of the inner conductor is a nominal diameter 4.3 mm of the traditional 4.3-10 type connector, with an error range within 0.05 mm. The outer conductor 54 is provided with external threads for engaging with the internal threads of the clamping nut 68. As an example, the diameter of the external thread is about 20 mm. The insulator 56 is provided between the inner conductor 52 and the outer conductor 54 for isolating and supporting the inner conductor 52 and the outer conductor 54. Specifically, the resilient finger-shaped element 58 is circumferentially surrounded by a main body portion 56' (see FIG. 8) of the insulator 56.

FIG. 6 shows one example of the male connector 60 of the anti-misplug coaxial connector according to the present disclosure. As shown in FIG. 6, the male connector 60 includes an inner conductor 62, an insulator 64, and an outer conductor 65. The inner conductor 62 defines the longitudinal axis of the coaxial connector. The inner conductor 62 includes a main body and a pin 63 having a diameter smaller than the outer diameter of the main body of the inner conductor, and the pin may be inserted into the elongated accommodation cavity 53 of the inner conductor 52 of the female connector 50. The insertion end portion of the pin may be formed in a frustoconical shape so as to be inserted into the accommodation cavity.

The outer conductor 65 may be formed as a single element, compared with a two-piece or multi-piece type conductor of the prior art (a two-piece or multi-piece type outer conductor needs to be machined separately and then formed via a press fit in the prior art—the processing precision requirements in actual production are high, the assembly tools are complex and sophisticated, and copper cuttings are generated in a pressing process easily to affect the passive intermodulation performance). The outer conductor is manufactured and assembled easily, and the passive intermodulation performance is improved. The single element includes a resilient finger-shaped element 66 engaging with the outer conductor 54 of the female connector 50 to form radial contact, and a flange 67 extending radially outwardly from the periphery of the outer conductor 65, wherein the flange 67 and the outer conductor 65 are formed into one piece. The resilient finger-shaped element 66 is formed at the free end portion. In the present disclosure, the outer conductor 65 itself is formed as the resilient finger-shaped element; there is no need to separately set the resilient finger-shaped element or the outer conductor, thereby simplifying the manufacturing process, reducing the manufacturing cost and improving the passive intermodulation performance. The resilient finger-shaped element 66 circumferentially surrounds the insulator 64 so as to provide good support and protection for the resilient finger-shaped element 66 under vibration and provide stable passive intermodulation (PIM) performance. In the present disclosure, the resilient finger-shaped element of the outer conductor is formed on the male connector instead of the female connector, so that when a similar interface male connector (e.g., the 4.1-9.5 type connector) is attempted to be plugged into the female connector, no accidental damage to the resilient finger-shaped element is generated, and a more robust interface design is provided.

Figure 9:
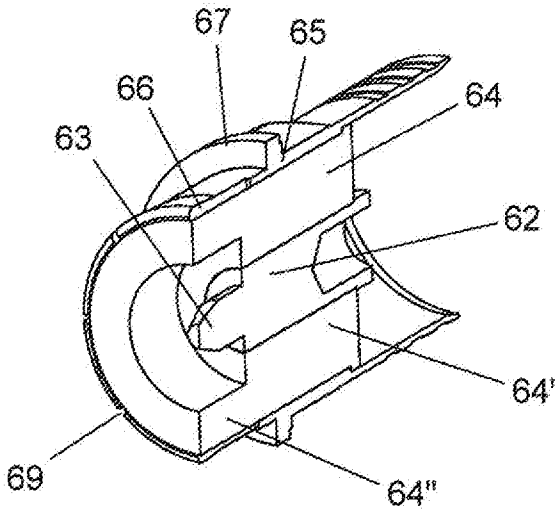
FIG. 9 shows a perspective section view of an inner conductor, an outer conductor and an insulator of a male connector according to an embodiment of the present disclosure.

Specifically, the resilient finger-shaped element 66 includes a plurality of slots 69 (see FIG. 9) extending around the periphery of the resilient finger-shaped element along the longitudinal axis; the plurality of slots 69 are uniformly arranged along the circumferential direction of the resilient finger-shaped element, wherein 3-8 slots are formed (commonly 8). Due to the arrangement of the slots 69, the resilient finger-shaped element 66 has good resilience, the resilient finger-shaped element 66 can generate elastic deformation upon the connection with the outer conductor 54 of the female connector 50, in order to generate a positive pressure at a contact position, form reliable contact, ensure the electrical continuity, and provide low and stable passive intermodulation performance. The flange 67 abuts against the clamping nut 68 and serves as a stop of the clamping nut 68. The male connector 60 is also provided with a resilient sealing element 61 arranged to be adjacent to the flange 67 and used for forming a sealed and secure connection between the male connector 60 and the female connector 50 so as to effectively prevent the radio frequency leakage and the external electromagnetic interference. The sealing element 61 is C-shaped or annular, and is preferably made of conductive rubber. The sealing element 61 is arranged to abut against the flange 67 and is located in the clamping nut 68, so that the sealing element 61 is hidden in the clamping nut 68 and is not easily lost or damaged by an external force in the case of field installation. In addition, the insulator 64 is arranged between the inner conductor 62 and the outer conductor 65 for isolating and supporting the inner conductor 62 and the outer conductor 65.

The inner conductors and the outer conductors of the male connector 50 and the female connector 60 are made of a metallic material such as copper. The insulators of the male connector 50 and the female connector 60 are made of an insulating material such as PTFE or TPX.

Figure 8:
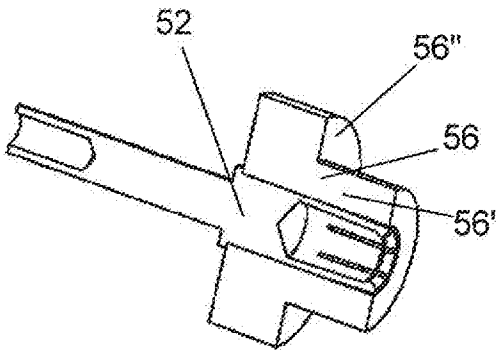
FIG. 8 shows a perspective section view of an inner conductor and an insulator of a female connector according to an embodiment of the present disclosure.

As shown in FIG. 8, the insulator 56 of the female connector 50 includes a main body portion 56' circumferentially surrounding the inner conductor 52 and having a free end portion, and the insulator 56 includes a shoulder portion 56" protruding outwardly relative to the main body portion 56' along the radial direction to engage the outer conductor 54 at the end portion opposite to the free end portion, so that the insulator 56 is formed with a recess between the main body portion 56' and the outer conductor 54 at the free end portion, and the insulator 56 of the female connector 50 forms an integral hollow T-shaped structure. As an example, the outer diameter of the main body portion 56' is about 10 mm, with an error range within 0.10 mm.

Correspondingly, the structure of the insulator 64 of the male connector 60 is configured to form a complementary cooperative connection with the insulator 56 of the female connector 50. The insulator 64 of the male connector 60 includes a main body portion 64' circumferentially surrounding the main body of the inner conductor 62 so as to support the main body of the inner conductor 62. The insulator 64 further includes an extension portion 64" that extends outwardly along the radial direction relative to the main body portion 64' of the insulator 64 and extends toward the free end portion along the longitudinal direction and exceeds the free end portion of the pin to engage with the outer conductor 65 so as to be inserted into the recess of the insulator 56 of the female connector 50 upon interconnection, in order to longitudinally abut the shoulder portion 56" of the insulator 56 of the female connector 50, such that the insulator 64 of the male connector 60 forms an integral hollow U-shaped structure. The free end portion of the extension portion 64" of the insulator 64 of the male connector 60 is flush with the free end portion of the outer conductor 65 of the male connector 60. As an example, the outer diameter of the main body portion 64' of the insulator 64 of the male connector 60 is 10 mm, with an error range within 0.10 mm.

The insulator 56 of the female connector 50 is formed with a recess located away from the longitudinal axis on the radial direction at the free end portion, in order to form a space for accommodating the extension portion 64" of the insulator 64 of the male connector 60. The insulator 64 of the male connector 60 is formed with a recess located (i.e., a position surrounding the pin of the inner conductor of the male connector 60) close to the longitudinal axis on the radial direction at the free end portion, in order to form a space for accommodating the main body portion 56' of the insulator 56 of the female connector 50. The hollow T-shaped structure of the insulator 56 of the female connector 50 forms a complementary cooperative connection with the hollow U-shaped structure of the insulator 64 of the male connector 60.

Figure 11:
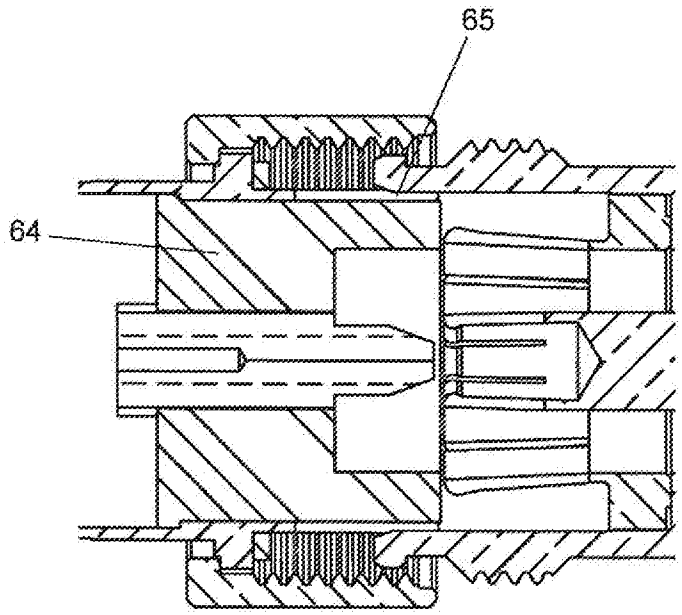
FIG. 11 shows a schematic section view when a 4.1-9.5 type female connector is attempted to be plugged into a 4.3-10 type male connector according to the present disclosure.
Figure 10:
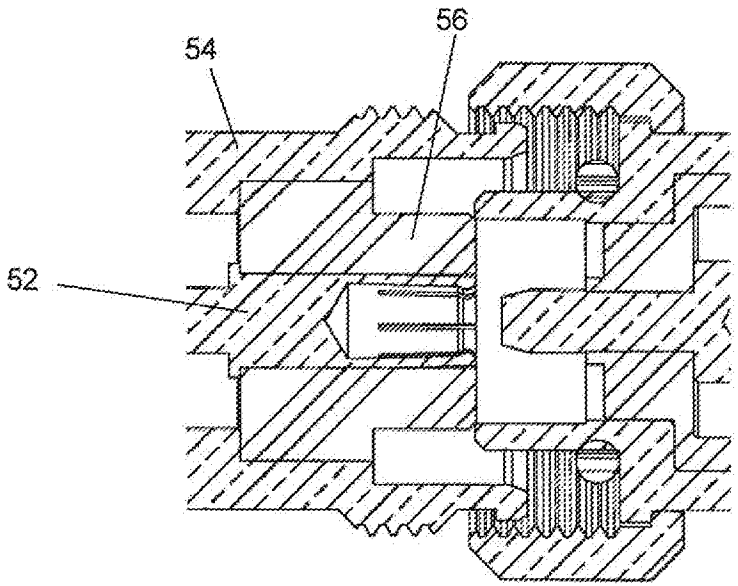
FIG. 10 shows a schematic section view when the 4.1-9.5 type male connector is attempted to be plugged into a 4.3-10 type female connector according to the present disclosure.

By adoption of the structure of the female connector 50 and the male connector 60, which are cooperatively connected with each other, in the present disclosure, the outer diameter (about 10 mm) of the main body portion 56' of the insulator 56 of the female connector 50 of the 4.3-10 type connector is greater than the inner diameter (about 9.5 mm) of the outer conductor of the male connector of the 4.1-9.5 type connector, so that when the two components are attempted to be cooperatively connected with each other, the main body portion can prevent the male connector of the 4.1-9.5 type connector from being plugged into the female connector of the 4.3-10 type connector by mistake, mismatch is avoided, and the accidental damage to the connector is reduced (see FIG. 10). In addition, when it is attempted to connect the male connector of the 4.3-10 type connector with the female connector of the 4.1-9.5 type connector, since the insulator and the outer conductor of the male connector of the 4.3-10 type connector collide with the outer conductor of the female connector of the 4.1-9.5 type connector, the two components cannot be plugged into each other, thereby avoiding the mismatch and reducing the accidental damage to the connector (see FIG. 11).

In the above embodiment, the inner conductor and the insulator of the female connector have aligned end faces at the free end portions. According to another embodiment of the present disclosure, beside including the features of the coaxial connector of the above embodiment, the free end portion of the insulator of the female connector may extend beyond the free end portion of the inner conductor of the female connector, so that the insulator of the female connector extends out a distance relative to the inner conductor at the free end portion so as to define a guide hole, so that when the pin of the inner conductor of the male connector is inserted into the accommodation cavity of the inner conductor of the female connector, guidance is provided for the pin. Due to the arrangement of the guide hole, the inner conductor of the male connector can be smoothly plugged into the inner conductor of the female connector, thereby effectively improving the cooperation efficiency of the inner conductors.

Although the exemplary embodiments of the present disclosure have been described, those skilled in the art should understand that they may make various changes and modifications to the exemplary embodiments of the present disclosure without departing from the spirit or scope of the present disclosure. Accordingly, all changes and modifications are included within the protection scope of the present disclosure as defined by the appended claims. The present disclosure is defined by the appended claims, and equivalents of these claims are also included therein.

The invention claimed is:

1. An anti-misplug coaxial connector assembly for preventing mismating, wherein the anti-misplug coaxial connector assembly comprises a female connector and a male connector, and each of the female connector and the male connector has a free end portion; the female connector and the male connector are cooperatively connected with each other by the free end portions, the female connector comprises:

a first inner conductor provided with a free end and an elongated accommodation cavity defining a longitudinal axis;

a first outer conductor; and a first insulator for isolating and supporting the first inner conductor and the first outer conductor, arranged between the first inner conductor and the first outer conductor, the first insulator having a free end extending to be substantially flush with the free end of the first inner conductor, the male connector comprises:

a second inner conductor provided with an elongated pin that can be inserted into the elongated accommodation cavity of the first inner conductor, a second outer conductor in radial contact with the first outer conductor when the female connector and the male connector are cooperatively connected with each other, and a second insulator for isolating and supporting the second inner conductor and the second outer conductor, the second insulator having a free end and being arranged between the second inner conductor and the second outer conductor, wherein the first outer conductor and the second outer conductor form radial contact by means of a resilient finger-shaped element having a free end, and the resilient finger-shaped element surrounds the second insulator and the free end of the finger-shaped element is substantially flush with the free end of the second insulator.

2. The anti-misplug coaxial connector of claim 1, wherein the second outer conductor is formed as a single element, and the second outer conductor is formed as the resilient finger-shaped element at the free end.

3. The anti-misplug coaxial connector of claim 1, wherein a main body portion and a shoulder portion of the first insulator form a hollow T-shaped structure, the second insulator is of a hollow U-shaped structure, and the T-shaped structure and the U-shaped structure form a complementary cooperative connection.

4. The anti-misplug coaxial connector of claim 1, wherein the first outer conductor of the female connector is provided with external threads, and the male connector comprises a clamping nut threaded connected with the external threads of the first outer conductor of the female connector.

5. The anti-misplug coaxial connector of claim 4, wherein the second outer conductor comprises a flange extending radially outwardly from the periphery of the second outer conductor, and the clamping nut abuts the flange of the second outer conductor so as to be connected with the first outer conductor, wherein the flange and the second outer conductor are formed into one piece.

6. The anti-misplug coaxial connector of claim 5, wherein the male connector is provided with a resilient sealing element for forming a sealed and secure connection between the first outer conductor and the second outer conductor, and the resilient sealing element is arranged to abut the flange.

7. The anti-misplug coaxial connector of claim 1, wherein the first inner conductor is provided with a resilient finger-shaped element for defining the accommodation cavity, and the resilient finger-shaped element of the first inner conductor is circumferentially surrounded by the first insulator.

8. The anti-misplug coaxial connector of claim 1, wherein the main body portion of the first insulator extends out a distance relative to the first inner conductor at the free end portion so as to define a guide hole that provides guidance for the pin when the pin is inserted into the accommodation cavity.

9. The anti-misplug coaxial connector of claim 3, wherein an outer diameter of the main body portion of the first insulator is about 10 mm.

10. An anti-misplug coaxial connector assembly for preventing mismating, wherein the anti-misplug coaxial connector assembly comprises a female connector and a male connector, and each of the female connector and the male connector has a free end portion; the female connector and the male connector are cooperatively connected with each other by the free end portions, the female connector comprises:

a first inner conductor provided with a free end and an elongated accommodation cavity defining a longitudinal axis;

a first outer conductor; and a first insulator for isolating and supporting the first inner conductor and the first outer conductor, arranged between the first inner conductor and the first outer conductor, wherein a main body portion and a shoulder portion of the first insulator form a hollow T-shaped structure, the male connector comprises:

a second inner conductor provided with an elongated pin that can be inserted into the elongated accommodation cavity of the first inner conductor, a second outer conductor in radial contact with the first outer conductor when the female connector and the male connector are cooperatively connected with each other, and a second insulator for isolating and supporting the second inner conductor and the second outer conductor, the second insulator being arranged between the second inner conductor and the second outer conductor and of a hollow U-shaped structure, wherein the first outer conductor and the second outer conductor form radial contact by means of a resilient finger-shaped element having a free end, and the resilient finger-shaped element surrounds the second insulator and the free end of the finger-shaped element is substantially flush with the free end of the second insulator, wherein the first insulator and the second insulator contact each other when the male connector and the female connector are cooperatively connected.

11. The anti-misplug coaxial connector of claim 10, wherein a main body portion and a shoulder portion of the first insulator form the hollow T-shaped structure, and wherein a free end of the U-shaped structure of the second insulator contacts the shoulder portion of the first insulator when are cooperatively connected.

12. The anti-misplug coaxial connector of claim 10, wherein the second outer conductor is formed as a single element, and the second outer conductor is formed as the resilient finger-shaped element at the free end.

13. The anti-misplug coaxial connector of claim 10, wherein the first outer conductor of the female connector is provided with external threads, and the male connector comprises a clamping nut threaded connected with the external threads of the first outer conductor of the female connector.

14. The anti-misplug coaxial connector of claim 13, wherein the second outer conductor comprises a flange extending radially outwardly from the periphery of the second outer conductor, and the clamping nut abuts the flange of the second outer conductor so as to be connected with the first outer conductor, wherein the flange and the second outer conductor are formed into one piece.

15. The anti-misplug coaxial connector of claim 14, wherein the male connector is provided with a resilient sealing element for forming a sealed and secure connection between the first outer conductor and the second outer conductor, and the resilient sealing element is arranged to abut the flange.

16. The anti-misplug coaxial connector of claim 10, wherein the first inner conductor is provided with a resilient finger-shaped element for defining the accommodation cavity, and the resilient finger-shaped element of the first inner conductor is circumferentially surrounded by the first insulator.

* * * * *